United States Patent [19]

Pawlak, deceased et al.

[11] 4,186,506

[45] Feb. 5, 1980

[54] PERCUSSION CAP NIPPLE

[75] Inventors: Daniel E. Pawlak, deceased, late of Issaquah, Wash.; by Catherine J. Pawlak, personal representative, Bellevue, Wash.

[73] Assignee: Michaels of Oregon Co., Portland, Oreg.

[21] Appl. No.: 890,617

[22] Filed: Mar. 20, 1978

[51] Int. Cl.[2] ..... F41C 27/00

[52] U.S. Cl. ..... 42/83

[58] Field of Search ..... 42/83, 51

[56] References Cited

U.S. PATENT DOCUMENTS

| | | | |
|---|---|---|---|
| 36,464 | 9/1862 | Hopkins | 42/51 |
| 60,791 | 1/1867 | Rowe | 42/83 |
| 3,757,447 | 9/1973 | Rowe | 42/51 |
| 3,780,464 | 12/1973 | Anderson | 42/51 |
| 4,123,866 | 11/1978 | Wiethoff | 42/83 |
| 4,123,867 | 11/1978 | Peterson | 42/83 |

*Primary Examiner*—Charles T. Jordan

*Attorney, Agent, or Firm*—Kolisch, Hartwell, Dickinson & Stuart

[57] ABSTRACT

A nipple for use in firearms employing percussion caps. The nipple includes an elongate body adapted at one end to receive a percussion cap, and adapted at its opposite end threadably to engage the ignition chamber housing of a firearm. A passage extending axially through the nipple includes a cylindrical primary section communicating with the cap-receiving end of the nipple, and a cylindrical constriction section communicating with the opposite end of the nipple body. These two sections intersect planar end faces of the nipple body substantially normal thereto. A cone-shaped section interconnecting the primary and constriction sections is dimensioned to have a greater volume and a lesser axial dimension than the constriction section.

1 Claim, 3 Drawing Figures

PERCUSSION CAP NIPPLE

BACKGROUND AND SUMMARY

The present invention relates to firearms, and in particular, to firearms employing percussion caps to ignite a propellant charge.

In the period between 1807 and 1825, there was developed a percussion firing method to replace the flintlock method for igniting a propellant charge in a firearm.

The basic elements of the percussion firing system are a percussion cap and a nipple communicating with the firearm ignition chamber. The percussion cap is designed to fit snugly over the nipple in a position to be struck by the hammer of the firearm. When struck, an explosive fulminate in the base of the percussion cap produces a quantity of burning gas in the nipple, and this gas is forced under considerable pressure into the ignition chamber of the firearm, igniting the propellant charge therein.

Heretofore, nipples usable in conjunction with percussion caps to ignite a propellant charge in a firearm have included an elongate body having a passage extending longitudinally therethrough. Such passage generally includes a cylindrical primary chamber communicating with a cap-receiving end of the nipple and a shorter, relatively small-bore constriction chamber communicating with the gas discharge end of the nipple. Additionally, there are generally provided tapered sections adjacent the two end regions of the nipple and a steep-walled tapered section interconnecting the two chambers.

Analyzing the above features, it may be said that the primary chamber serves as an explosion chamber for the percussion cap, and the constriction chamber serves to restrict flow of particles out of the primary chamber, whereby a high gas pressure within the primary chamber occurs at the time of the percussion explosion. The tapered section adjacent the cap-receiving end of the body, by decreasing the annular end surface area of the nipple, acts to increase the pressure exertable on the percussion cap upon impact of the firearm hammer. The tapered section adjacent the gas-discharge end of the nipple, by increasing the volume of the small-bore chamber, facilitates gas flow through the small-bore chamber. The tapered section interconnecting the two chambers accommodates entry of pressured gas from the primary chamber, through the constriction chamber, and into the firearm ignition chamber.

The above-described nipple has not been entirely satisfactory in that heated gases from the detonated percussion cap tend to blow back in the direction of the cap. Such blow-back adversely effects ignition efficiency, and may present a danger to the firearm user. Blow-back of heated gases may also occur upon ignition of the propellant charge in the firearm, further diminishing the firearm performance.

In the present invention there is provided a novel nipple in which blow-back of heated cap gases is substantially eliminated. Particular features of the present invention in nipple design responsible for reduced blow-back include an enlarged primary section, and a cone-shaped section which provides entry for gases from the primary section into a constriction section. Specifically, the volume of the primary section has been enlarged about twofold over earlier nipple designs. The volume of the cone-shaped section is dimensioned to have a greater volume and a lesser axial dimension than those of the constriction section. Additionally, the end regions of the primary and constriction sections are untapered, serving to reduce blow-back from the firearm and simplifying nipple construction.

It is a primary object of the present invention to provide a nipple of greatly improved efficiency which is useful in the ignition of a powder-loaded firearm ignited by use of a percussion cap.

More specifically, it is a purpose of the invention to provide such a nipple in which the blow back of cap gases is substantially eliminated.

Another object of the invention is to provide a nipple which is simple in construction.

DRAWINGS

These and other objects and features of the present invention will now be more fully described with reference to the drawings, wherein:

FIG. 1 is a fragmentary, side elevation of a percussion cap ignited firearm employing a nipple constructed in accordance with the present invention;

FIG. 2 is an enlarged, removed cutaway view of the ignition chamber structure of the firearm of FIG. 1 showing the mounting of the nipple, also illustrating a conventional percussion cap; and FIG. 3 is an enlarged longitudinal sectional view of the nipple of the invention, taken generally along line 3—3 of FIG. 1, with the nipple removed from the firearm and the percussion cap removed from the nipple.

DETAILED DESCRIPTION OF A PREFERRED EMBODIMENT OF THE INVENTION

Figure 1:
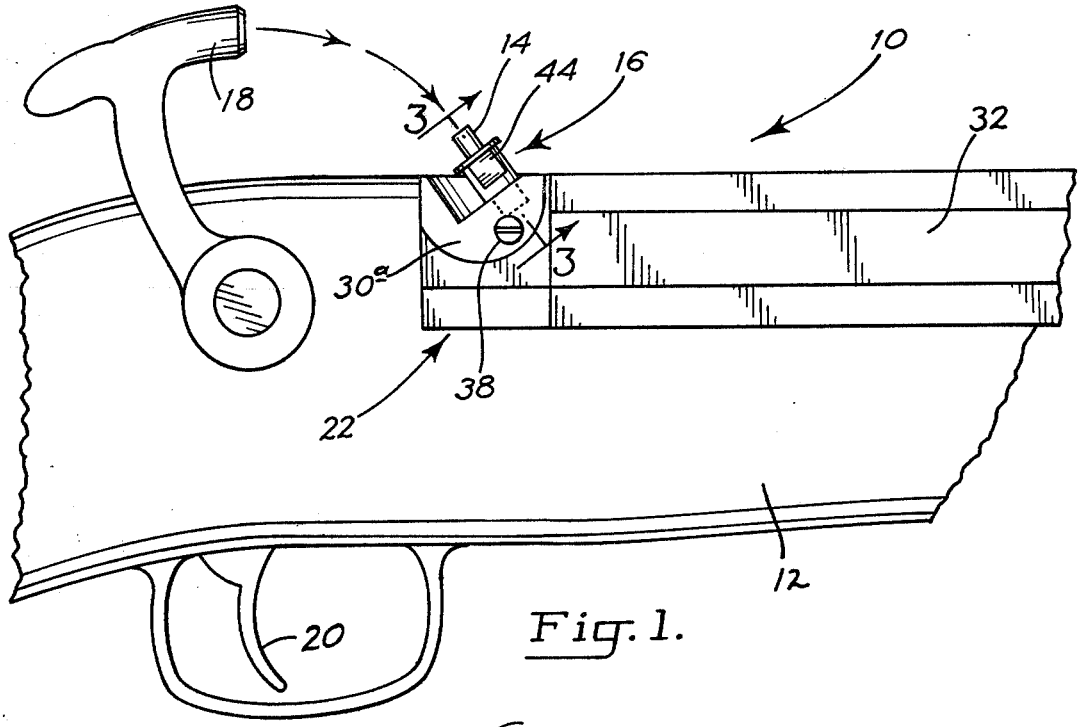

Referring now to FIG. 1, there is shown at 10 a portion of a firearm 12 employing a percussion cap firing system for igniting a propellant charge within the firearm. The basic elements of the percussion cap firing system include a percussion cap 14, a nipple 16 constructed in accordance with the invention, which nipple communicates with a powder chamber inside the firearm, as described below, and a spring-loaded hammer 18 releasable by a trigger 20.

The firearm includes what is referred to herein as an ignition housing 22 formed of a single piece of cast and machined steel. Housing 22, and attachment thereto of nipple 16 are shown in detail in FIG. 2. Considering FIGS. 1 and 2 together, housing 22 is formed with a body portion 24 joined with a threaded fitting portion 26, defining therewithin a powder chamber 28. Also forming part of the housing is a nipple mounting portion 30. Fitting portion 26 threadably attaches, as shown in FIG. 1, to barrel 32 of the firearm.

A roughly L-shaped passageway 36 extends through housing 22 externally from a transverse face **30*a* of the nipple mounting portion internally to chamber 28. The outer end of passageway 36 is blocked with a set screw 38, and the inner end of the passageway is reduced to form a port 40 which opens to chamber 28**.

Formed in nipple mounting portion 30, and extending normal to face **30*a* is a trench 41 defined by intersecting faces 41*a*, 41*b*. Extending normal to face 41*b*, inwardly toward, and opening to passageway 36 is a threaded bore 43**. The purpose for this bore will be explained shortly.

Figure 3:
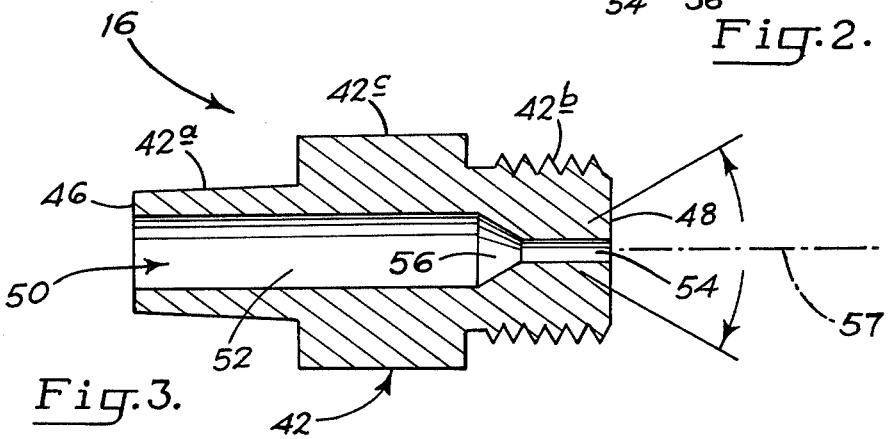

Viewing the construction of nipple 16 as shown in FIG. 3, there is provided an elongate body 42 having adjacent one end a cap receiving section **42*a*, adjacent the opposite end a threaded mounting section 42b, and a center section 42c joining sections 42a, 42b. Each of these sections has roughly the same longitudinal dimension. The outside of cap receiving section 42a is slightly tapered for receiving a similarly tapered percussion cap such as cap 14. Mounting section 42b is adapted threadably to engage previously-mentioned bore 43 in nipple mounting portion 30 of housing 22. Center section 42c provides two outwardly facing parallel-planar surfaces, such as surface 44**, by which the nipple may be tightly secured on the nipple mounting section.

The opposite ends 46 and 48 of body 42 are planar faces which occupy substantially parallel planes. Extending longitudinally through body 42, and opening at opposite ends thereof is a pasage 50, including a first larger-bore section 52, a second smaller-bore section 54 and a third intermediate section 56 which is tapered and which interconnects sections 52, 54. Sections 52, 54 are defined by cylindrical wall expanses which intersect faces 46 and 48, respectively, substantially normal thereto. Cone-shaped passage section 56 is defined by a conical wall disposed at an angle between about 25° and about 35° relative to longitudinal axis 57 of the nipple.

Passage section 52, also referred to herein as a first, or primary, chamber extends substantially completely through nipple sections 42a, 42c. Joined passage sections 56, 54, which together define what is referred to herein as a second, or funnel-shaped, chamber extend substantially completely through nipple section 42b. Passage section 56 is dimensioned to have a greater volume and a lesser longitudinal dimension than those of passage section 54, also referred to herein as a constriction chamber. The specified angular disposition of the conical wall expanse defining section 56, and the dimensional relationships between sections 56, 54, ensure that the ratio of diameters of sections 52 to 54 is at least 1.5. Preferably the ratio of such diameters is between 2 and 4.

Figure 2:
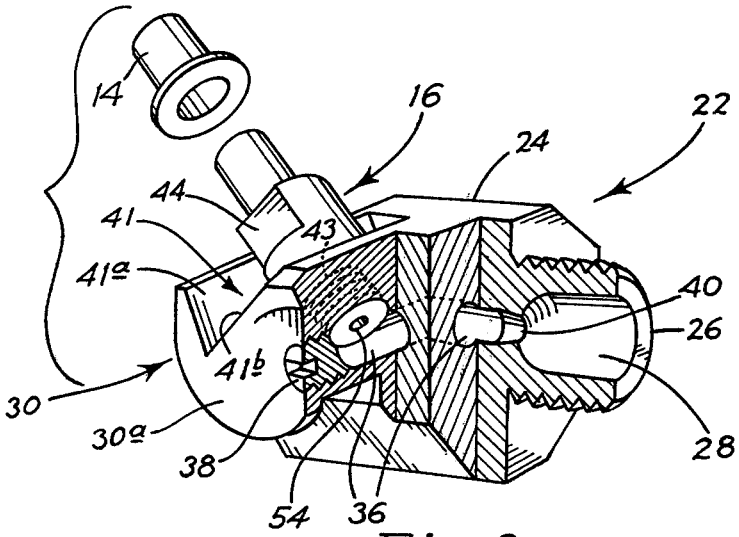

In operation, nipple 16 is threadably attached to housing 22 in such a manner that passage 50 communicates with passageway 36 (see FIG. 2). To ready the firearm for firing, a propellant charge such as gun powder is packed into chamber 28, and a percussion cap 14 is placed on the cap-receiving portion of the nipple. Cap 14 contains the usual internal explosive charge which, with the cap in place, rests against nipple face 46.

Spring-loaded hammer 18, when released by trigger 20, strikes the cap, exploding its charge. The exploding particles initially expand into nipple passage section 52 and are momentarily contained there under high pressure. This pressure forces the heated gases and particles through tapered conical section 56 and constriction section 54 into passageway 36, and thence through port 40 into firing chamber 28. Here the heated gases and particles ignite the propellant charge in the firearm.

As discussed above, the problem of blow-back has persisted throughout the history of the percussion cap firing system. The causes of gas blow-back are seen as follows: at the instant of cap firing, heated gas particles fill the primary or entry, of a nipple chamber, creating an intense pressure therewithin (for a brief period). If not quickly released into the main firing chamber, the pressurized particles of gas will blow back against the cap. Secondly, following ignition of the firearm propellant charge, a portion of the gases and particles from that charge are forced back through the usual inside-tapered end of the nipple creating further blow-back.

From the foregoing, it can be appreciated how the present invention in nipple design substantially eliminates blow-back. Principally, the nipple of the present invention is designed to extend the period during which the cap combustion products are contained within the primary chamber (passage section 52). This extended period of time allows more products of ignition to reach the propellant, and allows them to achieve the transfer over an extended period of time. To this end, the volume of such chamber has been increased approximately two-fold over that of such chambers found in similar sized nipples in the prior art.

Secondly, to facilitate the flow of gases out of the primary chamber a relatively large-volume cone-shaped chamber, is provided. The internal angle proposed herein for cone-shaped chamber walls has been empirically determined as the best compromise for volume and ease of flow of gases into the constriction chamber (passage section 54).

Finally, because the opening of constriction section 54 at nipple end 48 is untapered, blow-back of propellant charge ignition gases from the powder chamber into the nipple is reduced.

Another advantage derived from the present invention in nipple design is increased simplicity in construction. Because of the increased diameter of passage section 52, the annular end face 46 of the nipple has a reduced planar area, and therefore need not be tapered. Similarly, the present nipple design has reduced the need for an internal taper at end 48.

Various modifications and changes may be made in the above-described nipple design without departing from the true spirit of the invention, as set forth in the appended claims.

It is claimed and desired to secure by Letters Patent:

1. A nipple usable to ignite a propellant charge in a firearm of the type employing percussive ignition caps, said nipple comprising, an elongate body including, adjacent one end, a substantially cylindrical cap-receiving section, the outer surface of which is dimensioned to receive such caps slidingly thereon, and adjacent the other end, a mounting section, said body further including, adjacent said one and other ends, one and other end faces, respectively, which are planar and occupy substantially parallel planes, a first cylindrical wall expanse extending from said one end face, substantially perpendicular thereto, axially through a major portion of said nipple, defining a first, larger-diameter chamber therein, a second cylindrical wall expanse extending from said other end face, substantially perpendicular thereto, axially through a minor portion of said nipple, defining a second, smaller-diameter chamber therein, and a conical wall expanse which tapers radially inwardly, along the axial direction approaching said other end face, at an angle of between about 25° and about 35° relative to the longitudinal axis of said nipple, said conical wall expanse defining a conical chamber joining said first and second chambers, said conical chamber having a volume greater than, and a longitudinal dimension less than, that of said second chamber.

* * * * *